United States Patent [19]

Kawasaki et al.

[11] Patent Number: 4,842,206

[45] Date of Patent: Jun. 27, 1989

[54] AUTOMATIC YARN END FINDING DEVICE FOR A SPINNING BOBBIN

[75] Inventors: Yosio Kawasaki; Tatutake Horibe, both of Fujieda, Japan

[73] Assignee: Murata Kikai Kabushiki Kaisha, Kyoto, Japan

[21] Appl. No.: 135,850

[22] Filed: Dec. 21, 1987

[51] Int. Cl.[4] ..... B65H 54/00

[52] U.S. Cl. ..... 242/18 R; 242/35.5 R; 242/35.5 A; 242/35.6 E

[58] Field of Search ..... 242/18 R, 35.5 R, 35.5 A, 242/35.6 R, 35.6 E

[56] References Cited

U.S. PATENT DOCUMENTS

| | | | |
|---|---|---|---|
| 3,224,694 | 12/1965 | Oishi | 242/35.5 R |
| 3,563,478 | 2/1971 | Bell | 242/35.6 R |
| 3,727,852 | 4/1973 | Nelson et al. | 242/35.6 R |
| 3,941,323 | 3/1976 | D'Agnolo et al. | 242/18 R |
| 4,576,340 | 3/1986 | Aretz et al. | 242/35.5 A |
| 4,606,509 | 8/1986 | Hiroaki | 242/35.6 R |
| 4,616,789 | 10/1986 | Matsui et al. | 242/35.5 R |
| 4,619,416 | 10/1986 | Matsui et al. | 242/35.5 R |
| 4,634,065 | 1/1987 | Kupper et al. | 242/18 R |
| 4,681,271 | 7/1987 | Matsui et al. | 242/18 R |
| 4,735,369 | 4/1988 | Suzuki | 242/18 R |

*Primary Examiner*—Stanley N. Gilreath

*Attorney, Agent, or Firm*—Spensley Horn Jubas & Lubitz

[57] ABSTRACT

An automatic yarn end finding device for a spinning bobbin comprising a conveyor belt for transporting a spinning bobbin fitted on a peg tray, a gate-shaped suction tube which is located intermediate the passage of a spinning bobbin and which can be passed by a spinning bobbin, a rotary cutter located at one of a pair of base portions of the suction tube for releasing and cutting a tail portion of spinning yarn on a spinning bobbin, a stopper also located at the one base portion of the suction tube for stopping a spinning bobbin which has come to a position opposing to the rotary cutter, and a rotational driving device for driving a spinning bobbin stopped by the stopper to rotate.

16 Claims, 11 Drawing Sheets

AUTOMATIC YARN END FINDING DEVICE FOR A SPINNING BOBBIN

FIELD OF THE INVENTION

This invention relates to a device for finding an end of spinning yarn on a bobbin to prepare the spinning bobbin for a next step of rewinding, doubling, twisting or like operation in a spinning yarn transport line on which a spinning bobbin is transported using a peg tray in a spinning process.

RELATED ART STATEMENT

FIGS. 15 to 19 show an example of conventional automatic yarn end finding device for a spinning bobbin. In these figures, reference numeral 1 denotes a peg tray, and the peg tray 1 has an air hole 1*a* formed therein which extends from a bottom wall toward an upper end portion through the peg tray 1. Reference symbol 2 denotes a bobbin which can be fitted on the peg tray 1, and 2*a* a top hole formed in the bobbin 2. Reference numeral 3 denotes spinning yarn which has passed a spinning step, and in the case of FIG. 17, the spinning yarn 3 is wound on the bobbin 2. Reference numeral 4 (refer to FIG. 15) denotes a transporting rail for peg trays 1, and peg trays 1 are fed in a direction indicated by an arrow mark A in FIG. 15 under the guidance of the rail 4 by a conveyor belt (not shown) located in the rail 4. Reference numeral 5 denotes a tray moving turret located in an overlapping relationship above the rail 4, and when a tray 1 which has been fed along the rail 4 is fitted into one of recesses 5*a* formed in a disk at a lower part of the turret 5, the tray 1 is fed step by step along a circular passage in a direction indicated by an arrow mark B by intermittent feeding of the turret 5 at predetermined intervals of time.

In particular, when a spinning bobbin b integral with a tray 1 comes to the position indicated at I in FIG. 15, such a rotary cutter device 6 as shown in FIG. 16 is located at the position. Reference symbol 6*a* denotes a cutter body in the form of a ring which is formed by cutting a cylinder into a piece with a suitable width, and a large number of suction holes 6*b* are formed in the cutter body 6*a*. Here, the cutter body 6*a* is being rotated at a high speed by a motor 6*c* (refer to FIG. 15) by way of a belt 6*d*. Reference symbol 6*e* denotes a clamper which is located for sliding contact with an outer periphery of the cutter body 6*a*, and 6*f* a fixed cutter for preventing a found spinning yarn portion 3 from wrapping around the cutter body 6*a*. Further, reference symbol 6*g* denotes a suction port communicating with the inside of the cutter body 6*a*, and the suction port 6*g* is connected to a suction hose 6*h* shown in FIG. 15.

Meanwhile, a spinning bobbin b which has come to the position I of FIG. 15 is rotated in a direction indicated by an arrow mark C in FIG. 15 by means of such a rotational driving device 7 as shown in FIG. 17. In particular, reference symbol 7*a* in FIG. 17 denotes a driving roller for contacting under pressure with an outer periphery of a tray 1, and 7*b* and 7*c* denotes each a driven roller.

Accordingly, since a yarn tail portion of a spinning bobbin b is opposed to the rotary cutter device 6 which is rotating in a direction indicated by an arrow mark D while the spinning bobbin b is rotating in the direction of the arrow mark C at the position I, a tail or end portion of the yarn of the spinning bobbin b is released and cut at a suitable position, and the waste yarn portion thus cut off is sucked into the suction hose 6*h*.

Then, after lapse of a predetermined time, the turret 5 is rotated by one step in the direction of the arrow mark B again. Consequently, the spinning bobbin b is fed along the circular path from the position I to another position indicated at II at which the spinning bobbin b is rotated in a direction indicated by an arrow mark E by a rotational driving device similar to the rotational driving device 7 described above. This is done in a direction in which the found and picked up spinning yarn 3 is to be wound around the bobbin 2.

Then, after the predetermined time has elapsed again, the turret 5 is rotated further by one step in the direction of the arrow mark B so that the spinning bobbin b is fed along the circular path from the position II to a further position indicated at III. At the position III, a suction pipe 8 having a slit 8*a* therein by way of which a tail portion of yarn of a spinning yarn 3 can be sucked into the suction pipe 8 is located and connected to a suction hose 8*b* as shown in FIG. 15. Meanwhile, a spinning bobbin b which has come to the position III is rotated in a direction of an arrow mark C by way of such a rotational driving device 7 as shown in FIG. 17. Since such rotation is made in a direction in which a tail portion of the spinning yarn 3 is to be unwound, the yarn tail portion is sucked into the suction pipe 8 by way of the slit 8*a*.

Then, after lapse of the predetermined time, the turret 5 is rotated by one step again in the direction of the arrow mark B to feed the spinning bobbin from the position III to a still further position indicated at IV.

Accordingly, the found spinning yarn portion 3 sucked in the suction pipe 8 via the slit 8*a* is engaged with a found yarn end detecting sensor 9 built in the cutter 9*a* and thus cut by the cutter 9*a*. Further at the position IV, the peg tray 1 overlies a suction port 10 as shown in FIG. 18. Accordingly, the found spinning yarn portion 3 thus cut off is sucked into the bobbin 2 via the top hole 2*a* of the bobbin 2 as shown in FIG. 19, thereby completing finding of the end of the yarn of the spinning bobbin b.

Then, after lapse of the predetermined time, the turret 5 is rotated further by one step so that the tray 1 of the spinning bobbin b is received by the belt conveyor of the rail 4 again and is thereafter transported on the latter in the direction of the arrow mark A.

In the case of such a conventional spinning yarn end finding device as described above, since spinning bobbins are fed one after another to the device at predetermined intervals whether or not ends of yarn thereon have been successfully picked up, if the cycle time does not include a statistically sufficient spare time therein, there are problems that it is difficult to maintain the ratio of failure in finding an end of yarn in a desired condition and that the loss of yarn waste, electric power, injected air and so on is great. There are further drawbacks that since the rotary cutter and the suction mouth are separated at two stations, they are complicated in structure, and additionally since the direction of transportation is a horizontal direction, the floor space is increased for storage of spinning bobbins and also for re-circulation of spinning bobbins for which finding of ends of yarn has failed.

Besides, it is a still further problem that since a part located near the floor must be repaired for maintenance in a very uncomfortable posture as in a tray transporting device of a conventional system, also an operation for maintenance is difficult.

OBJECT AND SUMMARY OF THE INVENTION

It is an object of the present invention to provide a yarn end finding device wherein a spinning bobbin is forwarded immediately if finding of the spinning bobbin is detected.

In order to resolve the problems described above, according to an embodiment of the present invention, an automatic yarn end finding device for a spinning bobbin is constituted such that it comprises a conveyor belt for transporting a spinning bobbin fitted on a peg tray which has an air hole therein, a gate-shaped suction tube which is located intermediate the passage of a spinning bobbin by the conveyor belt and which can be passed by a spinning bobbin, a rotary cutter located at one of a pair of base portions of the suction tube for releasing and cutting a tail portion of spinning yarn on a spinning bobbin, a stopper also located at the one base portion of the suction tube for stopping a spinning bobbin which has come to a position opposing to the rotary cutter, a rotational driving device for driving a spinning bobbin stopped by the stopper to rotate, the gate-shaped suction tube sucking air via the other base portion thereof, the suction tube having a slit formed in an inner wall thereof, and a sensor for detecting a spinning yarn sucked into the suction tube when the found spinning yarn is drawn to the air sucking side, the sensor having a cutter for cutting the found spinning yarn portion, whereby the stopper is released in response to a finding detecting signal from the sensor to allow the spinning bobbin to be moved to a position above a suction port so that a found spinning yarn end portion may be sucked into the bobbin via a top hole of the bobbin, and when the finding of an end of yarn is not effected successfully within a fixed period of time, a yarn end finding assisting device is operated for a fixed period of time and then the stopper is released to allow spinning bobbins to be moved by one spinning bobbin distance.

DETAILED DESCRIPTION OF PREFERRED EMBODIMENTS

Figure 1:
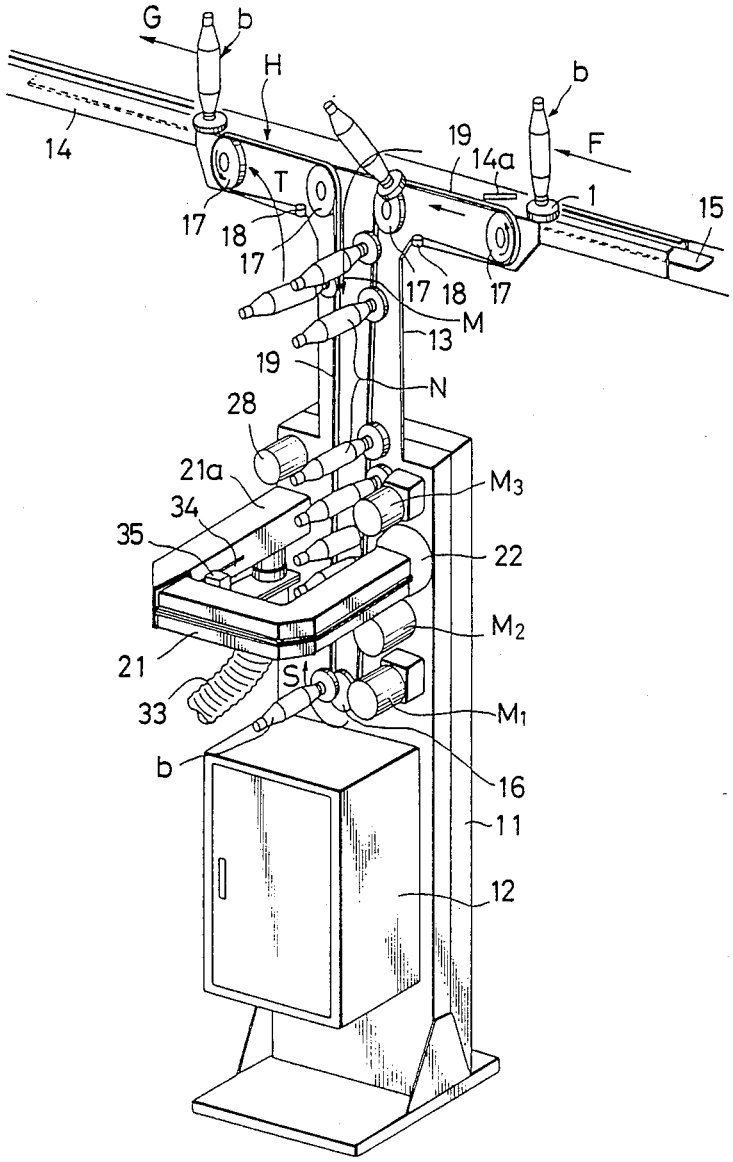
FIG. 1 is a perspective view showing the structure of an entire device of an embodiment of the present invention.

Now, an embodiment of the present invention will be described with reference to the drawings. In the drawings, like reference symbols to those appearing hereinabove denote like parts or elements.

FIG. 1 shows structure of an entire device of an embodiment of the present invention, and in FIG. 1, reference numeral 11 denotes a frame of the vertical type which is erected uprightly on a floor, 12 a control box located at a lower portion of a front face of the frame 11, 13 a T-shaped frame plate provided projectingly at the top of the frame 11, 14 a peg tray transporting rail disposed horizontally along an upper side of the frame plate 13, and 15 a main conveyor belt located in the rail 14. In particular, the rail 14 extends, for example, between a spinning frame (not shown) and a rewinding machine (not shown) and transports spinning bobbins b after completion of a spinning step on the spinning frame in a direction indicated by an arrow mark F together with a peg tray 1. And a spinning bobbin b for which an end of yarn has been found by a yarn end finding device of the FIG. 1 embodiment of the present invention which will be hereinafter described is placed again onto the rail 14, which thus transports the spinning bobbin b in a direction indicated by an arrow mark G and feeds it into the rewinding or doubling.

Thus, in order to introduce a spinning bobbin b from the rail 14 into the yarn end finding device of the present invention and transfer the spinning bobbin b having an end of yarn thereon found again to the rail 14, a twisting transporting device H for a spinning bobbin b is located on the front faces of the frame plate 13 and an upper portion of the frame 11.

Figure 2:
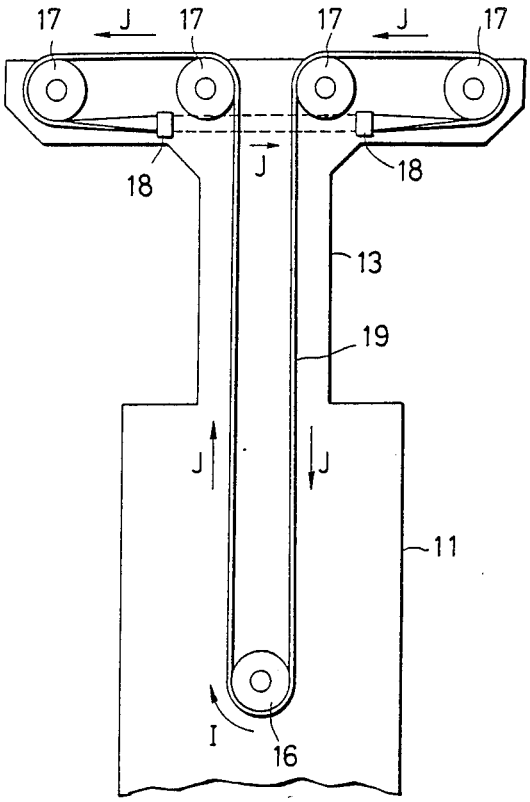
FIG. 2 is an elevational view showing a transmission system of a conveyor belt for twisting transportation of the device of FIG. 1.
Figure 4A:
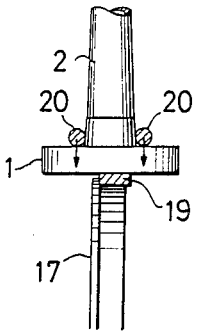
FIGS. 4*a*, 4*b* and 4*c* are views illustrating an action of the twisting transporting device of FIG. 3.
Figure 4B:
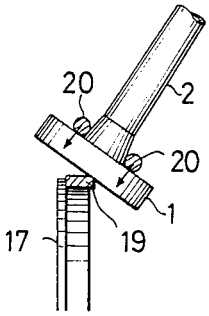
Figure 4C:
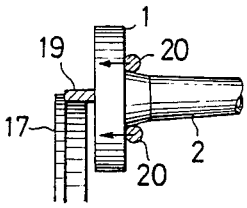

For the twisting transporting device H, a spinning bobbin transporting device of Japanese Patent Application No. 61-22089 (Provisional Publication No. 62-180882, published on Aug. 8, 1987) which has been filed precedingly may be employed. A transmission system employing a belt in the transporting device is such as shown in FIG. 2, and in FIG. 2, reference numeral 16 denotes a conveyor driving pulley which is driven by a motor $M_1$ (refer to FIG. 1), four reference numerals 17 denote each a driven pulley, two reference numerals 18 denote each a guide roller, and reference numeral 19 denotes a conveyor belt of the flat type.

Thus, by rotating the conveyor driving pulley 16 in a direction indicated by an arrow mark I, the conveyor belt 19 is moved in a direction indicated by arrow marks J.

Figure 3:
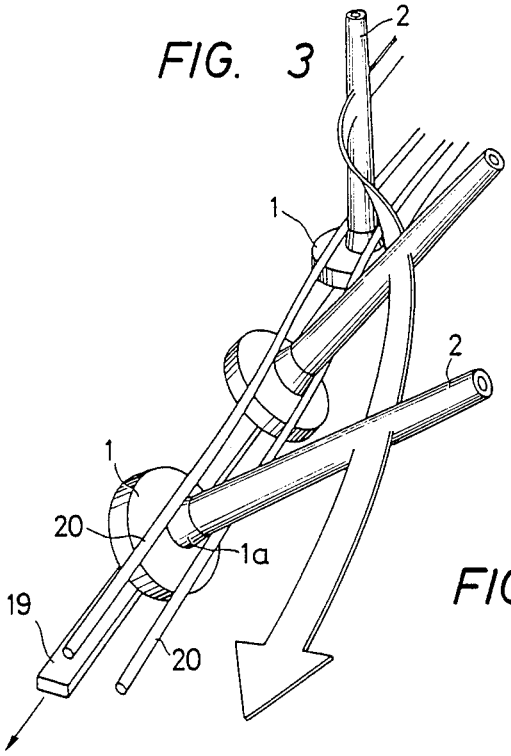
FIG. 3 is a view illustrating a principle of a twisting transporting device.
Figure 5:
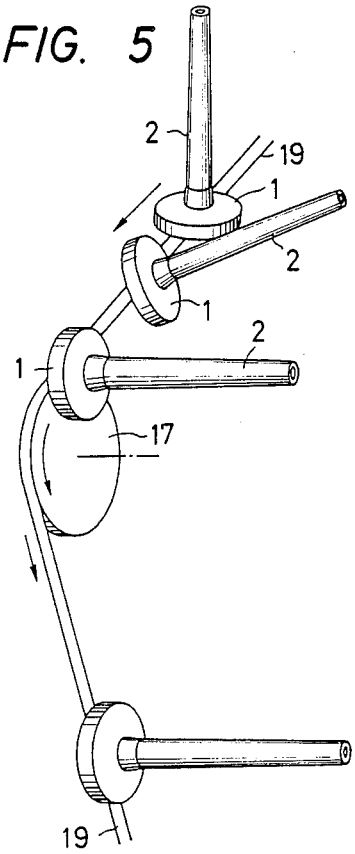
FIG. 5 is a partial perspective view showing an operating condition of a peg tray and a bobbin by twisting transportation.

FIG. 3 is a view illustrating a principle of twisting transportation, and two reference numerals 20 denote a pair of resilient guides for clamping a projection 1*a* of a peg tray 1 therebetween and for pressing a bottom face of the peg tray 1 against the conveyor belt 19. As the resilient guides 20 are extended in a twisted condition relative to the conveyor belt 19, the peg tray 1 and a bobbin 2 thereon are transported while being twisted as shown in FIGS. 4*a*, 4*b*, 4*c* and 5.

In the present embodiment, a gate-shaped suction tube 21 which can be passed by a spinning bobbin b with a peg tray 1 being transported by the conveyor belt 19 is provided on the front face of the frame 11 as shown in FIG. 1. The gate-shaped suction tube 21 is constituted from a hollow square tube shaped substantially into a gate shape, and a rotary cutter housing 22 of a substantially cylindrical shape is provided at one of a pair of base portions of the gate-shaped suction tube 21. A rotary cutter 23 for releasing and cutting a tail of yarn on a spinning bobbin is located in the housing 22.

Figure 7:
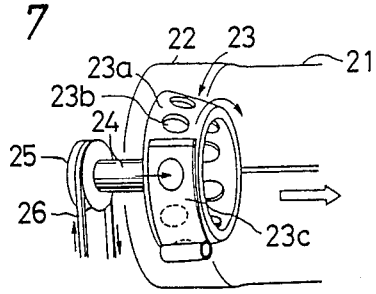
FIG. 7 is a perspective view of a rotary cutter.
Figure 8:
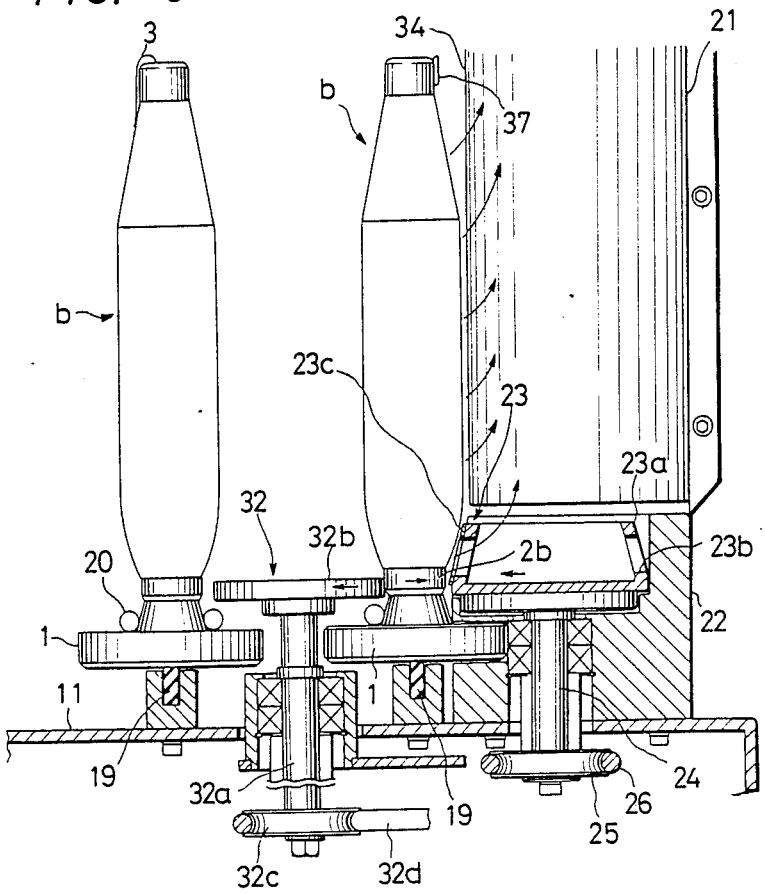
FIG. 8 is a transverse sectional view showing the rotary cutter and a rotational driving device.

As shown in FIGS. 7 and 8, reference symbol 23*a* denotes a rotary cutter body, and this rotary cutter body 23*a* is formed in a hollow truncated conical shape and has a large number of holes 23*b* distributed and provided on an outer peripheral wall thereof. Further, reference symbol 23*c* denotes a clamper located for sliding contact with the rotary cutter body 23*a*, 24 a shaft of the rotary cutter body 23*a*, 25 a pulley fixedly mounted on the shaft 24, and 26 a belt for the pulley 25. Thus, the rotary cutter body 23*a* is rotated at a high speed by a motor $M_2$ shown in FIG. 1.

Further, a stopper 27 (refer to FIGS. 6*c*, 9 and 10) for stopping a peg tray 1 of a spinning bobbin b transported thereto by the conveyor belt 19 is located at a position opposing to the rotary cutter 23. Reference symbol 27*a* denotes a shaft which extends through and is supported for rotation on the frame 11, 27*b* an arm securely mounted on the shaft 27*a*, and 27*c* a roller supported for rotation at a free end portion of the arm 27*b*. Thus, as the roller 27*c* is abutted with an outer periphery of a peg tray 1, the peg tray 1 is stopped at the position, and as the arm 27*b* is pivoted to move the roller 27*c* away from the peg tray 1, stopping of the tray 1 is canceled. Reference symbol 28 denotes a rotary solenoid provided on the frame 11 for actuating the stopper 27, 28*a* a shaft of the rotary solenoid 28, 29 an arm securely mounted on the shaft 28*a*, 30 another arm securely mounted on the shaft 27*a*, and 31 a rod interconnecting free end portions of the arms 29 and 30.

A rotational driving device 32 is also provided for rotating a spinning bobbin b held stopped by the stopper 27. Reference symbol 32*a* denotes a shaft which extends through and is supported for rotation on the frame 11, and 32*b* a driving roller securely mounted on the shaft 32*a*. Thus, a ring made of urethane and provided on an outer periphery of the roller 32*b* is contacted under pressure with a lower end portion 2*b* of a bobbin 2 of a spinning bobbin b. Reference symbol 32*c* denotes a pulley securely mounted on a portion of the shaft 32*a* which extends rearwardly from a rear face of the frame 11, and 32*d* a belt for the pulley 32*c*, and the belt 32*d* is driven by a spinning bobbin rotating driving motor $M_3$ shown in FIG. 1.

Figure 9:
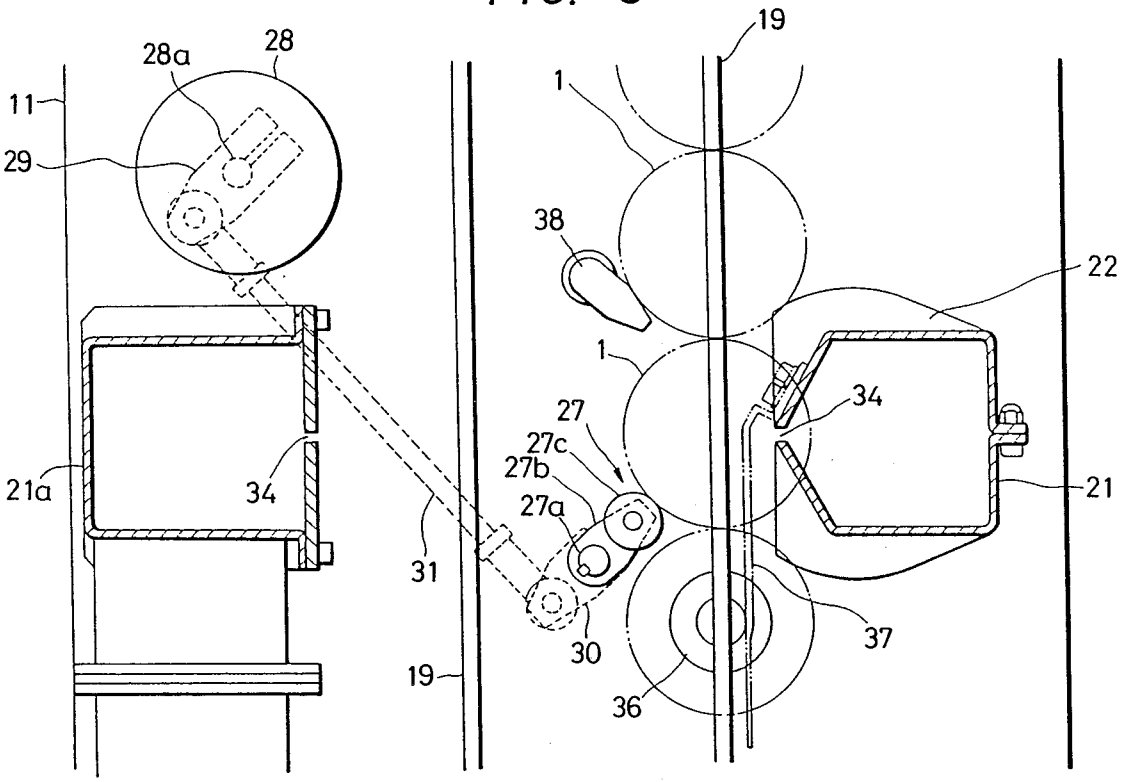
FIG. 9 is a partial elevational view of a frame showing a gate-shaped suction tube in section.

Further, the other base portion 21*a* of the gate-shaped suction tube 21 is connected to an air sucking device (not shown) such as a vacuum pump by way of a suction hose 33 (refer to FIG. 1). And, a slit 34 is provided continuously in an inside wall of the gate-shaped suction tube 21 from a portion near the rotary cutter 23 to the other base portion of the gate-shaped suction tube 21 as shown in FIGS. 6*b* and 9, and a sensor 35 (refer to FIGS. 1 and 6*c*) for detecting a found spinning yarn 3 sucked into the suction tube 21 when the found yarn end 3 is then drawn to the air sucking side is located inside the gate-shaped suction tube 21. The sensor 35 has built therein a cutter (not shown) for cutting a found spinning yarn 3 when it is detected by the sensor 35. In response to a yarn end finding detection signal from the sensor 35, the rotary solenoid 28 is rendered operative to cancel the stopped condition of a peg tray 1 by the stopper 27 to allow a spinning bobbin b to be moved downwardly together with the tray 1 by an action of the conveyor belt 19.

Figure 10:
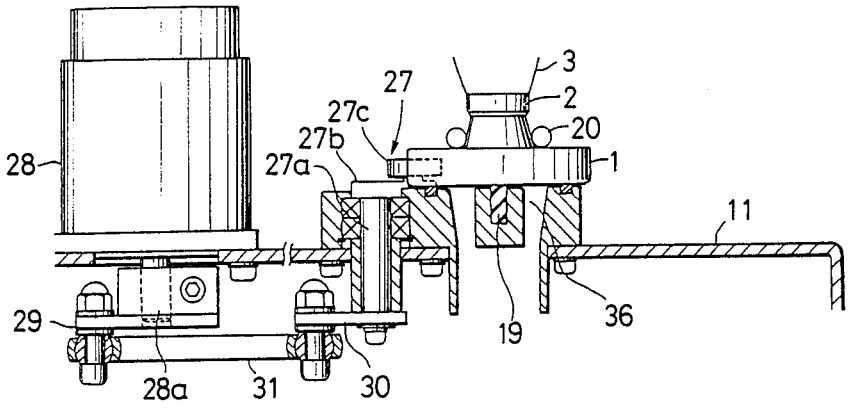
FIG. 10 is a transverse sectional view of a suction port of the gate-shaped suction tube of FIG. 9 and a shaft of a stopper.

A suction port 36 in the form of a ring is provided at a position displaced downwardly by a distance corresponding to about one peg tray from the position of a peg tray 1 stopped by the stopper 27 as shown in FIGS. 9 and 10. And the suction port 36 is connected to an air sucking device not shown.

Figure 6A:
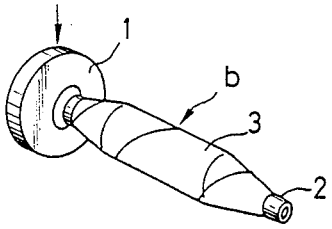
FIGS. 6*a* to 6*e* are partial perspective views illustrating an operation of the device of an embodiment of the present invention.
Figure 6D:
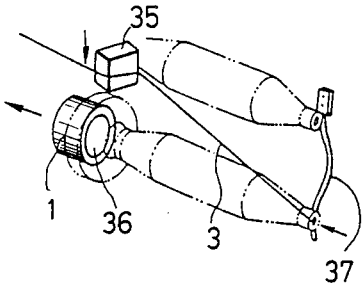
Figure 6B:
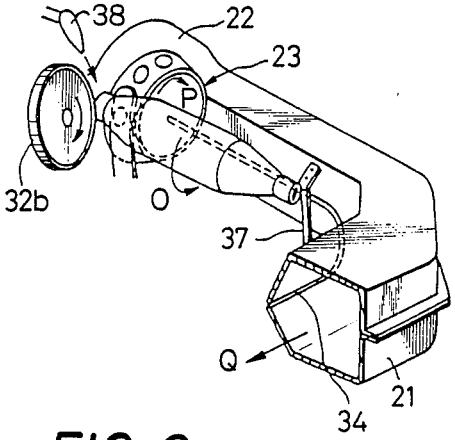
Figure 11:
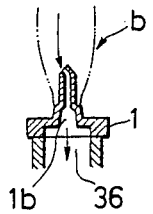
FIG. 11 is a partial sectional view illustrating an action of the suction port.

Accordingly, if a peg tray 1 overlaps the suction port 36 as shown in FIGS. 6*d* and 11, external air is violently sucked into the suction port 36 through the top hole 2*a* of the bobbin 2 of a spinning bobbin b due to the presence of the air hole 1*b* in the peg tray 1, and by an action of the air being sucked, a found spinning yarn end portion 3 cut by the sensor 35 is sucked into the top hole 2*a* of the bobbin 2.

It is to be noted that reference numerals 37 appearing in FIGS. 6*b*, 6*c*, 6*d* and 9 denotes a guide bar which guides a found spinning yarn end portion 3 to a position near the top hole 2*a* of the bobbin 2, and the guide bar 37 is secured to the inside of the gate-shaped suction cylinder 21 as shown in FIG. 9.

Further, in case such finding of an end of yarn as described above is not effected successfully within a predetermined period of time, a yarn end finding assisting device is operated for a predetermined period of time and then the stopper 27 is released to allow spinning bobbins b to be moved by one bobbin distance by the conveyor belt 19.

Reference numerals 38 appearing in FIGS. 6*b* and 9 denote a jet injection nozzle which serves as such a yarn end finding assiting device as described above, and when finding of an end of yarn is not effected successfully within a predetermined period of time, air is blown from the nozzle 38 to a yarn tail portion of spinning yarn 3 for a predetermined period of time to promote releasing of a tail portion of the yarn.

Figure 13A:
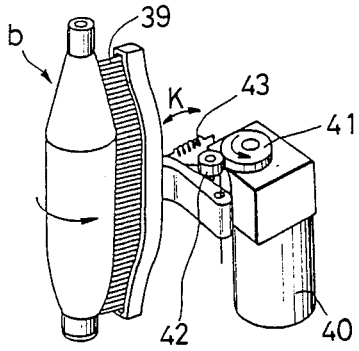
FIG. 13*a* is a perspective view of a vibration brush.
Figure 13B:
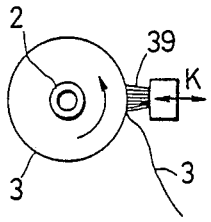
FIG. 13*b* is a plan view of part of the vibration brush of FIG. 13*a*.
Figure 14A:
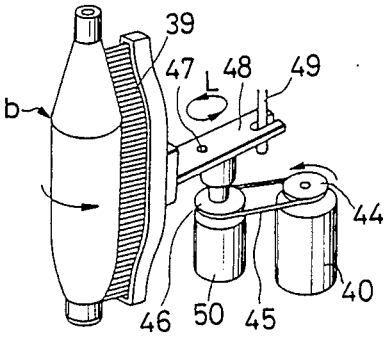
FIG. 14*a* is a perspective view of another vibration brush.
Figure 14B:
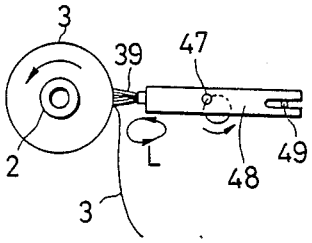
FIG. 14*b* is a plan view of part of the vibration brush of FIG. 14*a*.
Figure 15:
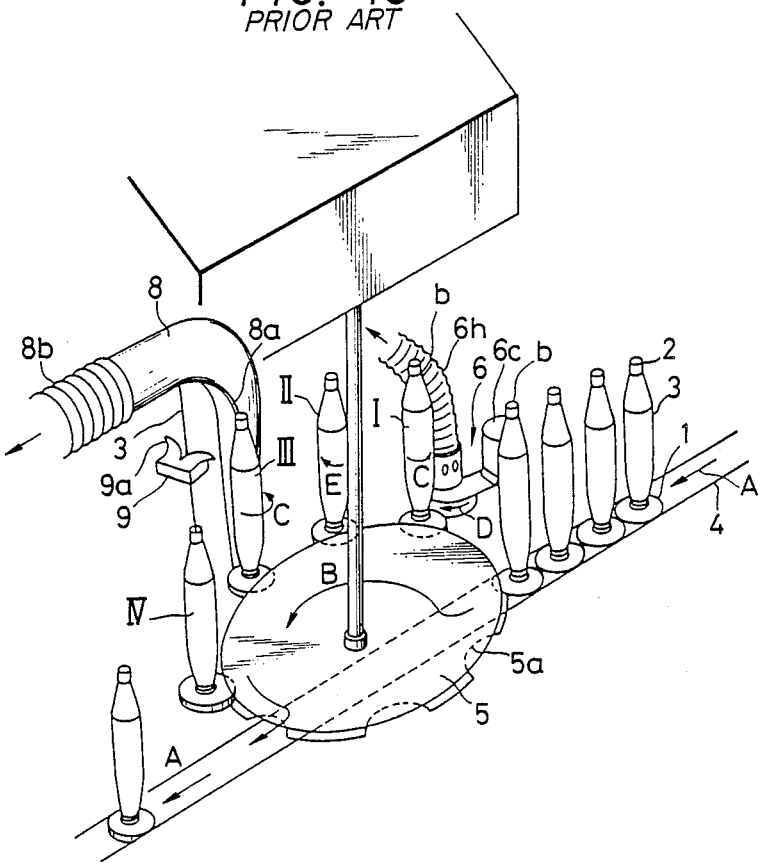
FIG. 15 PRIOR ART
FIG. 15 is a perspective view showing essential part of a conventional device.
Figure 16:
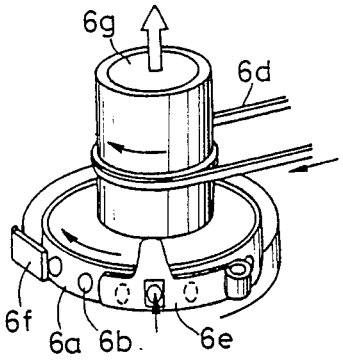
FIG. 16 PRIOR ART
FIG. 16 is a perspective view of a rotary cutter of the device of FIG. 15.
Figure 17:
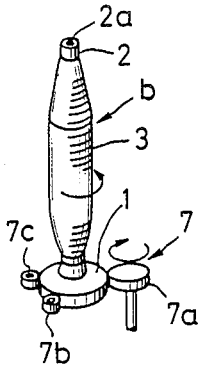
FIG. 17 PRIOR ART
FIG. 17 is a perspective view of a peg tray rotational driving device.
Figure 18:
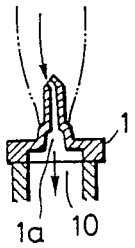
FIG. 18 PRIOR ART
FIG. 18 is a partial plan view of a suction port.
Figure 19:
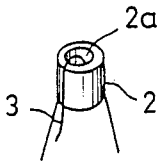
FIG. 19 PRIOR ART
FIG. 19 is a perspective view of an end portion of a spinning bobbin.

Further, FIGS. 13 and 14 show a vibration brush 39 which serves as another yarn end finding assiting device, and in the case of FIG. 13, a cam 41 is rotated by a motor 40 to vibrate the brush 39 in opposite directions as indicated by an arrow mark K via a cam follower 42 to promote releasing of spinning yarn 3. It is to be noted that reference numeral 43 denotes a return spring.

Meanwhile, in the case of FIG. 14, an eccentric pin 47 is moved round by a motor 40 via a pulley 44, a belt 45 and another pulley 46 so that a lever 48 which is integral with the brush 39 and is held in engagement with the eccentric pin 47 may be pivoted around a fulcrum provided by a fixed pin 49 to move an end portion of the lever 48 round in a direction indicated by an arrow mark L together with the brush 39 in order to promote releasing of found spinning yarn 3. It is to be noted that reference numeral 50 denotes a bearing housing for supporting a shaft of the pulley 46 thereon.

Related operations among the various mechanisms in the device of the present invention described above are made by way of an electric circuit. However, since such an electric circuit is already known.

Figure 20:
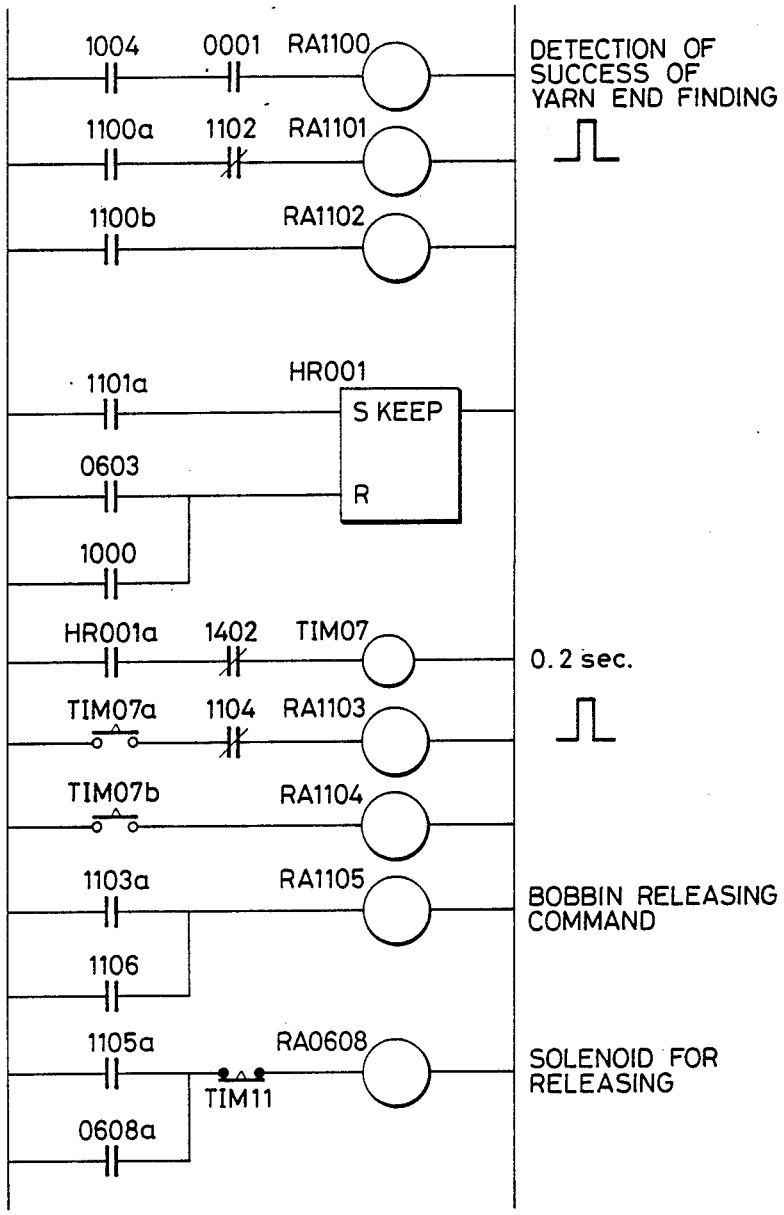
FIG. 20 is a circuit diagram for releasing a spinning bobbin from a stopper.

Now, FIG. 20 shows an example of a circuit diagram for releasing a spinning bobbin and allowing it to be moved when the rotary solenoid 28 for driving the stopper 27 is actuated by a yarn end finding detecting signal from the sensor 35.

If the sensor 35 detects a presence of a yarn therein during the yarn end finding operation, (that is, during a contact 1004 being kept "on",) a contact 0001 is closed and a relay RA1100 is put on. Then, the relay RA1101 is put on in a moment and a keep relay HR001 is energized. According to "on" of a contact HR001*a*, a timer TIM07 is excited. After 0.2 sec. due to a contact TIM07*a*, a relay RA1103 is put on in a moment. On closing of a contact 1103*a*, a relay RA1105 for issuing a spinning bobbin releasing command is put on. While, a contact 1106 being parallel with a contact 1103*a* is closed when a yarn end finding operation is failed. According to "on" of the relay RA1105, a contact 1105*a* is closed and a relay RA0608 for a solenoid or releasing a spinning bobbin is energized to release the spinning bobbin.

Now, action of the device of the present invention having such a construction as described above will be described.

Figure 6E:
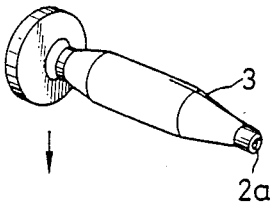
Figure 6C:
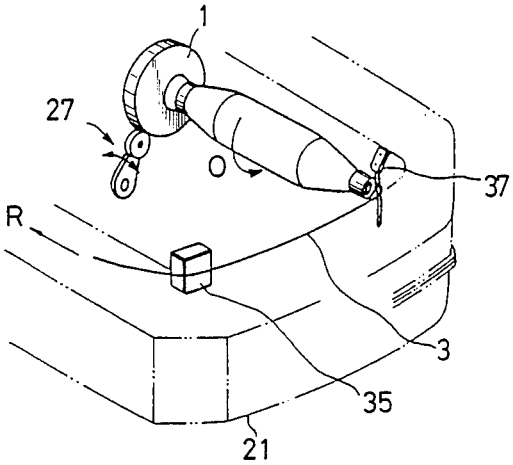

A spinning bobbin b transported in the direction of the arrow mark F in FIG. 1 by the rail 14 is transferred to the conveyor belt 19 by the guide 14*a* and is then moved vertically downwardly in a direction indicated by an arrow mark M in FIG. 1 along the frame plate 13 by the above described twisting transporting device including the conveyor belt 19. Then, when the peg tray 1 comes to a position near the gate-shaped suction tube 21 as shown in FIG. 6*c*, the spinning bobbin b is stopped once at the position together with the peg tray 1 by the stopper 27. Accordingly, a succeeding spinning bobbin b will thereafter wait above the spinning bobbin b. In particular, a location denoted at N in FIG. 1 makes a storage station for spinning bobbins b.

After the spinning bobbin b shown in FIG. 6*b* reaches the position of FIGS. 6*b* and 6*c* and further downward movement thereof is stopped by the stopper 27, the spinning bobbin b is rotated in a direction indicated by an arrow mark O by the driving roller 32*b* of the rotational driving device 32 (refer to FIG. 8). In this instance, since the rotary cutter body 23*a* (refer to FIG. 8) opposing to a yarn tail portion of the spinning bobbin b is rotated at a high speed in a direction indicated by an arrow mark P and the inside of the rotary cutter body 23*a* is acted upon by a negative pressure via the gate-shaped suction tube 21, a tail portion of yarn of the spinning bobbin b is released and sucked into a hole 23*b* of the rotary cutter body 23*a*. Since the yarn tail thus sucked is cut at a portion thereof adjacent the clamper 23*c*, an end portion of the spinning yarn 3 thus cut and a waste yarn portion thus cut off are both sucked into the gate-shaped suction tube 21. And since the spinning yarn 3 sucked into the suction tube 21 is pulled in a direction indicated by arrow marks Q and R in FIGS. 6*b* and 6*c*, respectively, at first the end portion of the spinning yarn 3 passes the sensor 35 and then a portion of the spinning yarn 3 which has been within the suction tube 21 is moved outwardly through the slit 34 and thus extended between the guide bar 37 and the sensor 35 as shown in FIG. 6*c*. And then when the sensor 35 detects the found yarn end portion 3, the stopper 27 is once pivoted upwardly in response to such detection signal. Consequently, the spinning bobbin b is fed downwardly together with the peg tray 1 by an action of the conveyor belt 19.

It is to be noted that in case finding of an end of yarn is not effected successfully after lapse of the predetermined period of time in such a yarn end finding operation as described above, a yarn end finding assisting device is rendered operative by an action of a timer not shown. In particular, in the case of FIGS. 6*b* and 9, air is injected from the jet injection nozzle 38, and in the case of FIGS. 13 and 14, the vibration brush 39 is vibrated, to promote releasing of a tail portion of yarn. It is to be noted that since an operating time of either of the yarn end finding assisting devices is set to a fixed time by the timer, a spinning bobbin for which finding of an end of yarn has not been effected successfully even by operation of the yarn end finding assisting device is removed as a finding failed spinning bobbin.

Figure 12:
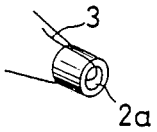
FIG. 12 is a perspective view of an end portion of a spinning yarn bobbin.

Since the peg tray 1 fed downwardly in such a manner as described above now overlies the suction port 36 as shown in FIGS. 6*d*, 10 and 11, air is sucked into the suction port 36 through the top hole 2*a* of the bobbin 2 by way of the air hole 1*b* of the peg tray 1 and the found yarn end portion 3 is cut by the cutter built in the sensor 35. Consequently, the found yarn end portion 3 of a fixed length is sucked into the bobbin 2 through the top hole 2*a* as shown in FIGS. 6*e* and 12. It is to be noted that in this instance the guide bar 37 acts to introduce the found yarn end portion 3 to a position near the top hole 2*a*. Then, the spinning bobbin b with the peg tray is pushed to move downwardly by the succeeding peg tray 1 above and is then moved in a direction indicated by arrow marks S and T in FIG. 1 by the conveyor belt 19 again whereafter it is transported in the direction of the arrow mark G by the main conveyor belt 15 of the rail 14.

Since the device of the present invention is constituted such that a stopper 27 is released to allow a spinning bobbin b to be moved to a position above a suction port 36 in response to a found yarn end detection signal from a sensor 35 which detects a found spinning yarn portion 3 sucked into a gate-shaped suction tube 21 when the found spinning yarn portion 3 is drawn to the suction side and which has a cutter for cutting the found spinning yarn portion 3, if finding of the spinning yarn portion is detected, the spinning bobbin b can be forwarded immediately even if a fixed period of time does not yet elapse as distinct from a conventional device. Therefore, according to the present invention, excellent effects can be anticipated that the efficiency in yarn end finding operation is improved remarkably, that the amount of waste yarn is reduced and that consumption of the electric power and injection air is also reduced.

In particular, according to examination conducted with the conventional device described hereinabove and the device of the present invention for comparison therebetween, the maximum number of spinning bobbins processed for one minute was 30 on the conventional device and the maximum number was 40 on the device of the present invention.

Further, calculation of an average save amount of waste yarn for one spinning bobbin revealed that the average save amount by the device of the present invention was reduced to 50% of that by the conventional device Besides, measurement of consumption of compressed air and electric power revealed that such consumption by the device of the present invention is reduced by 30% comparing with that by the conventional device.

In addition, such effects can be anticipated that since in the device of the present invention a rotary cutter 23 and a suction mouth of a gate-shaped suction tube 21 are provided at one location, the device of the present invention is simplified in structure and facilitated in production, and since the entire device can be of the vertical structure employing twisting transportation, the installation space is reduced and operation for maintenance and checking can be facilitated.

In the embodiment aforementioned, a spinning bobbin having a bunch winding at a lower portion of the bobbin is applied to and a tail yarn is found. However, a spinning bobbin having a bunch winding at top end of the bobbin, that is, having a top-bunch as disclosed in U.S. Pat. No. 4,681,271 may also be used in the present invention.

What is claimed is:

1. An automatic yarn end finding device for a spinning bobbin which is located intermediate the passage of a spinning bobbin fitted on a peg tray and transported by a conveyor belt and readys a spinning bobbin from which an end of yarn is found and hung into a take-up tube of the spinning bobbin, characterized in that said yarn end finding device comprises:

a rotary cutter for releasing and cutting a bunch winding portion of yarn on a spinning bobbin;

a stopper located at a position opposing to the rotary cutter;

a suction tube for sucking the cut and released yarn end from the spinning bobbin;

a sensor for detecting a spinning yarn sucked into the suction tube and having a cutter for cutting the found yarn end portion; and means for releasing said stopper in response to said sensor detecting a spinning yarn sucked into the suction tube to allow the spinning bobbin to be moved.

2. The automatic yarn end finding device as claimed in claim 1, wherein said yarn end finding device further includes a yarn end finding assisting device, means for operating said yarn end finding assisting device for a fixed period of time when the sensor does not detect a spinning yarn sucked into the suction tube in a certain time, and said means for releasing said stopper includes means for releasing said stopper to move the spinning bobbin after the operation of the yarn end finding assisting device.

3. The automatic yarn end finding device as claimed in claim 2, wherein said finding assisting device is a jet injecting device.

4. The automatic yarn end finding device as claimed in claim 2, wherein said finding assisting device is a vibration brush device.

5. The automatic yarn end finding device as claimed in claim 1, wherein said suction tube is a gate-shaped suction tube which can be passed by a spinning bobbin being fitted on the peg tray and provides a slit formed in an inner wall thereof for sucking the found yarn end portion.

6. The automatic yarn end finding device as claimed in claim 5, wherein said gate-shaped suction tube is provided at a location at which a spinning bobbin is transported vertically by the conveyor belt.

7. The automatic yarn end finding device as claimed in claim 1, wherein said yarn end finding device further includes a rotational driving device for driving a spinning bobbin stopped by said stopper.

8. A yarn end finding method for a spinning bobbin comprising steps of stopping a spinning bobbin, which is carried on a peg tray and is transported by a conveyor belt, by a stopper at a yarn end finding station; rotating the spinning bobbin for releasing a bunch winding portion of the yarn on the spinning bobbin; cutting the released bunch winding portion of the yarn; and sucking the released and cut yarn end portion from the spinning bobbin into a suction tube, characterized in that a success of yarn end finding operation is detected by a sensor by detecting a presence of a sucked yarn and portion therein and releasing the spinning bobbin from the stopper and advancing the spinning bobbin in response to the detecting of a sucked yarn end portion by said sensor.

9. A yarn end finding device for finding a yarn end wound about a spinning bobbin, the device comprising:

stopping means for stopping the spinning bobbin;

releasing and cutting means operable on the stopped spinning bobbin for releasing and cutting a bunch winding portion of the yarn wound about the spinning bobbin to provide a cut and released yarn end;

suction means for sucking the cut and released yarn end from the spinning bobbin;

sensing means for detecting the yarn sucked by the suction means;

releasing means, operable in response to the detection of yarn being sucked by the suction means, for releasing the spinning bobbin stopped by the stopping means.

10. A yarn end finding device as claimed in claim 9, further comprising:

conveying means for conveying the spinning bobbin toward the releasing and cutting means and for conveying the spinning bobbin away from the releasing means.

11. A yarn end finding device as claimed in claim 10, further comprising:

yarn end freeing means for freeing the yarn end wound about the spinning bobbin; and operating means for operating the yarn end freeing means for a predetermined period of time.

12. A yarn end finding device as claimed in claim 11, wherein the yarn end freeing means comprises a jet means for blowing a jet of air toward the spinning bobbin.

13. A yarn end finding device as claimed in claim 11, wherein the yarn end freeing means comprises a moveable brush.

14. A yarn end finding device as claimed in claim 9, wherein the suction means comprises:

a gate-shaped suction tube having an inner wall, means for passing the gate-shaped suction tube by a spinning bobbin, the inner wall of the gate-shaped suction tube having a slit formed therein through which the cut yarn end is sucked.

15. A yarn end finding device as claimed in claim 9, further comprising a rotational driving device for rotatably driving a spinning bobbin stopped by the stopping means.

16. A method for finding a yarn end on a moving spinning bobbin comprising steps of:

stopping the moving spinning bobbin;

rotating the spinning bobbin for releasing a bunch winding portion of yarn on the spinning bobbin;

cutting the released bunch winding portion of the yarn;

sucking the released and cut yarn end portion from the spinning bobbin into a suction tube;

detecting the presence of yarn in the suction tube;

moving the spinning bobbin in response to the detection of yarn in the suction tube.

* * * * *